US005447090A

United States Patent [19]

Adams

[11] Patent Number: 5,447,090

[45] Date of Patent: Sep. 5, 1995

[54] REMOTE CONTROL FOR BULK EXPLOSIVES DELIVERY SYSTEM

[75] Inventor: Robert G. Adams, Allentown, Pa.

[73] Assignee: ICI Explosives USA Inc., Tamaqua, Pa.

[21] Appl. No.: 122,779

[22] Filed: Sep. 16, 1993

[51] Int. Cl.[6] ..... F42B 3/00

[52] U.S. Cl. ..... 86/20.15; 102/312; 102/313

[58] Field of Search ..... 86/20, 15; 102/312, 102/313

[56] References Cited

U.S. PATENT DOCUMENTS

| | | | |
|---|---|---|---|
| 4,102,240 | 7/1978 | Cook et al. | 86/20 C |
| 4,685,375 | 8/1987 | Ross et al. | 86/20.15 |
| 4,966,077 | 10/1990 | Halliday et al. | 102/313 |
| 5,007,345 | 4/1991 | O'Garr | 102/313 |

*Primary Examiner*—Peter A. Nelson

*Attorney, Agent, or Firm*—Charles Q. Buckwalter, Jr.

[57] ABSTRACT

The present invention is directed to a delivery system for bulk explosives whereby said system is remotely controlled by electronic or electrical controls.

12 Claims, 1 Drawing Sheet

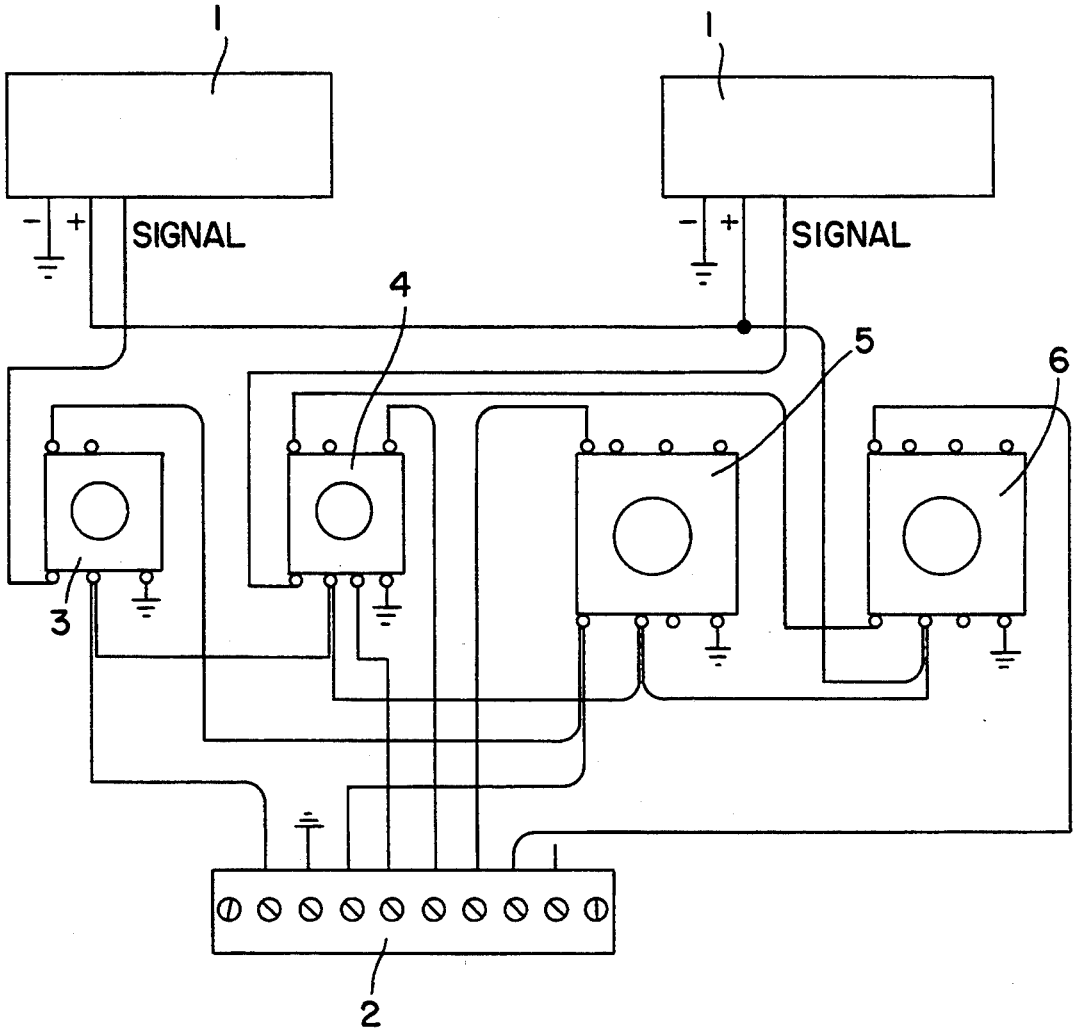
1
1
SIGNAL
SIGNAL
4
5
6
3
2

REMOTE CONTROL FOR BULK EXPLOSIVES DELIVERY SYSTEM

BACKGROUND

The present invention is directed to remotely controlling the delivery system for filling boreholes with bulk explosives.

Presently, boreholes are loaded with bulk explosives employing a delivery system comprising a bulk explosives reservoir, a filling means usually a hose for most purposes or a wand for upholes, pumps, control center, and several operators. Typically, an operator will be hoisted in a basket type lift, wherein the operator is then placed proximate to the borehole. Upon the appropriate command to a ground situated operator, the delivery of the bulk explosive is commenced. Further communication is required between the operators in order to finish the delivery for each borehole.

Commonly, bulk explosives such as emulsions are loaded into the borehole with a hose. The emulsion may have a consistency much like peanut butter. At times the pumping means for emulsion delivery will fail to operate correctly. When this occurs, the hose must be backed out of the borehole to be cleared and delivery may begin anew. To facilitate the removal of the hose from the borehole a continuous flow of water is infused into the hose to remove the emulsion. The emulsion must be removed to insure proper pump operation within standard safety requirements before restarting delivery. Once the hose is cleared, the borehole may again receive the appropriate amount of emulsion. At the end of the delivery of emulsion at a specific blast site, the hose must be cleared of emulsion. This is generally done with compressed or forced blast of air of some kind to clear the hose.

A problem in the bulk delivery art is the inconvenience of controlling the active delivery of the explosives through some communication means between operators. There is also an additional expense which must be incurred, since in the present delivery scenarios, more than one operator is required to complete a bulk delivery.

The present invention is directed to the use of a remote control means to perform the functions required of the additional operator, thus obviating the need thereof and providing the sole operator with a convenient means to operate bulk delivery functions. An additional advantage of the control means is to give the operator control from the proximate delivery position. There is little need for operator removal from the proximate area of the borehole, prior to completion of loading. The present invention is found useful for the delivery of bulk explosives in upholes, downholes, and drifts.

SUMMARY OF THE INVENTION

A remote control bulk delivery system comprising a means of delivering bulk explosives wherein said system provides an in-flow means of said explosives into a single or a plurality of boreholes, borehole clearing means, and a delivery clearing means whereby said means are controlled at a remote distance. The remote control may be electrically or electronically configured. Preferably, the remote control is RF (radio frequency) configured. In its most general aspect, bulk explosives, for example emulsions, are pumped into a borehole. The pumping means is situate vicinal to the reservoir of the bulk explosives and may be controlled at the reservoir. The present invention places a receiver, such as a radio frequency receiver, at the pumping means which is capable of receiving signals from a remote control device. The signals transmitted and received actuate the pump, provide a signal to actuate a means to in-fuse water into a delivery hose if needed, and provide a signal to actuate a means to clear a blocked hose.

Referencing the Figure, a transmitting means, 1, actuates relays 3 and 4. Relay 3 is actuated to start functions, relay 4 is actuated to stop functions. The transmitter comprises three functions that may be in either an on or off state. The three functions control pumping, water in-flow to clear the hose, and compressed air or some forced gas to clear the hose. To begin the delivery of the bulk explosives, a signal is initiated at 1 by the operator, said signal is received at receiver, 2. The receiver is proximately placed at a control center which functionally actuates the pumping, water, and compressed or pressurized air sources. When the pumping means is required for delivery, relay 3 is actuated which starts the pump.

Should water for the hose be desired, the operator transmits a signal specific for the water from transmitter 1 to receiver 2. Relay 3 is actuated which actuates timer 5. Timer 5 delays the actuation of the water for about 3 seconds to prevent water infusion each time the pump is actuated. Providing such a time function decreases the requirement for additional receivers at the control center since the water source may be circuited through the pumping receiver circuit. The preferred time delay is approximately 3 seconds.

The compressed air means functions similarly to the water. When transmitter 1 is actuated for the compressed air, relay 3 is actuated which actuates timer 5 which delays for preferably about 3 seconds prior to actuating the infusion of compressed air through the hose. When either compressed air or water is actuated, the pump is deactivated.

The above embodiment of the present invention is presented for illustrative purposes. Those skilled in the electronics or electrical arts who also are skilled in the bulk explosives art could vary the transmitter/receiver signalling functions to provide a similar signalling means. It is contemplated herein, that other remote control technologies could be advantageously employed to provide control at a distance. In the present invention, control may be applied from a distance of up to about 150 feet (45.87 meters). Other technologies may provide similar control greater than and/or less than 150 feet. Although additional technologies may be employed, the nub of the invention is the application of remote control technology to perform the several functions, heretofore, performed by multiple operators.

A frequency output of transmitter 1 is generated by less than about 0.5 of a millionth volt. It is important that the voltage remain low since inadvertent detonation may occur with improvident results should electric caps be used in the blast design. In addition to controlling voltage, a code is emplaced for each frequency employed to insure that frequency overlap with some other radio frequency controlled system does not occur with similar mishaps.

I claim:

1. A remote control bulk delivery system comprising a means of delivering bulk explosives wherein said system provides an in-flow means of said explosives into a single or plurality of boreholes, a borehole clearing means, and a delivery clearing means whereby said means are controlled by a transmitting and receiving means comprising RF frequency.

2. The bulk explosives of claim 1 wherein said explosives is an emulsion.

3. The system of claim 1 wherein said system comprises a transmitting means, a receiving means, and a pumping means.

4. The system of claim 1 wherein said system is remotely controlled by electronic means.

5. The system of claim 3 wherein said receiving means comprises a timing function.

6. The system of claim 5 wherein said timing function comprises about a 3 second delay.

7. The system of claim 3 wherein said transmitting means comprises a frequency output generated by less than about 0.5 of a millionth volt.

8. The system of claim 1 wherein said borehole clearing means comprises water.

9. The system of claim 1 wherein said delivery clearing means comprises compressed gas.

10. The system of claim 9 wherein said delivery clearing means comprises compressed air.

11. The system of claim 1 wherein said delivery clearing means comprises pressurized gas.

12. The system of claim 1 wherein said system is remotely controlled by electrical means.

* * * * *